US006422046B1

(12) United States Patent
Wissmann

(10) Patent No.: US 6,422,046 B1
(45) Date of Patent: Jul. 23, 2002

(54) LATCH NEEDLE HAVING AN IMPROVED TRAPPING SPACE

(75) Inventor: Siegfried Wissmann, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/834,903

(22) Filed: Apr. 16, 2001

(30) Foreign Application Priority Data

Apr. 15, 2000 (DE) ..... 100 18 798
Nov. 22, 2000 (DE) ..... 100 57 765

(51) Int. Cl.[7] ..... D04B 35/04
(52) U.S. Cl. ..... 66/121
(58) Field of Search ..... 66/121, 116, 120, 66/122

(56) References Cited

U.S. PATENT DOCUMENTS 938,795 A * 11/1909 Scott ..... 66/121
1,354,096 A * 9/1920 Fels ..... 66/121
1,764,342 A * 6/1930 Parlini ..... 66/121
2,536,478 A * 1/1951 Vitoux ..... 66/121
2,596,311 A * 5/1952 Vitoux ..... 66/121
2,817,222 A * 12/1957 Noe ..... 66/121
4,096,713 A * 6/1978 Lopes, Jr et al. ..... 66/121
5,090,218 A * 2/1992 Schuler et al. ..... 66/121

FOREIGN PATENT DOCUMENTS

DE 1069812 * 11/1959 ..... 66/121
DE 2834558 * 2/1979 ..... 66/121
GB 1 596 619 8/1981
GB 2232689 * 12/1990 ..... 66/121
JP 34-15353 9/1934

* cited by examiner

*Primary Examiner*—Danny Worrell
(74) *Attorney, Agent, or Firm*—Venable; Gabor J. Kelemen

(57) ABSTRACT

A latch needle includes a shank; a hook formed at an end of the shank and having a hook tip; and a latch pivotally supported by the shank and cooperating with the hook. The latch has a closed state and a reverse state. In the closed state the hook and the latch together define a closed trapping space and in the reverse state the hook defines an open trapping space constituted essentially by an inner hook space. The latch includes an inner contour facing the trapping space in the closed state, a free end lying on the hook in the closed state and a stepped portion formed on the inner latch contour and adjoining the free latch end.

11 Claims, 6 Drawing Sheets

LATCH NEEDLE HAVING AN IMPROVED TRAPPING SPACE

CROSS REFERENCE TO RELATED APPLICATION

This application claims the priority of German Application Nos. 100 18 798.6 filed Apr. 15, 2000 and 100 57 765.2 filed Nov. 22, 2000, which are incorporated herein by reference.

BACKGROUND OF THE INVENTION

This invention relates to a latch needle, particularly for knitting machines and more particularly for circular knitting machines.

Latch needles are utilized, for example, in circular knitting machines. At one end the latch needles have a hook, adjoined by a latch which is pivotally supported in a sawslot of the latch needle. The latch is arranged in such a manner that in its closed state it lies at or on the end of the hook and closes the trapping space partially bounded by the hook. In its open state the latch is swung back to rest on its back and thus opens the trapping space. Such latch needles which are present in large numbers in knitting machines, are supported in needle beds in which, during operation of the knitting machine, they are rapidly reciprocated in their longitudinal direction. During this occurrence, the latches snap open and closed. For this purpose they have to move easily which, as a rule, requires a certain lateral play between the latch and the needle.

During the knitting operation the hook of the latch needle captures a thread while the needle executes its reverse stroke. A thread which is located behind the latch situated in its reverse state, lies on the upper side of the needle and first closes the latch. Upon further needle motion the thread slides off the hook resulting in the formation of a loop. The thread captured by the hook during this occurrence must be able to slide in the inner hook space and the trapping space must be closed by the latch. Only upon the successive movement of the needle in the opposite direction may the thread slide out of the inner hook space, opening the catch and the trapping space. If the latch is lifted from the hook earlier and thus the trapping space is opened and the thread moves out of the trapping space between the hook tip and the latch, loops will be dropped, resulting in a defective knit of unacceptable quality Latch needles are also frequently used to produce dual-thread knits. To ensure that such knits have a uniform appearance, it is of the utmost importance that the threads do not switch their sequence in the trapping space of the latch needle. Dual-thread knits, so-called plated knit goods, are manufactured frequently with a combination of unlike threads, for example, a natural fiber yarn and an elastomer thread. In such a product the elastomer thread should, as a rule, be situated on that side of the product which is not visible (that is, on the reverse side of the item). Such a requirement is not fulfilled if the threads switch position. Such an occurrence results in an undesired pattern because, as a rule, the two threads have different shapes and/or color as well as other different properties.

Further, particularly monofilaments, such as elastomer threads are reacting very strongly to damages. Deep surface scratches must be definitely avoided, since even the slightest damage to the thread surface may lead to thread breakage.

Latch needles are known, for example, from German Patent No. 1,069,812. The latch needle has a pivotally supported latch, whose latch spoon (noucat) is provided with a groove for receiving the hook tip. The latch is linear along its inner contour which bounds the trapping space in the closed state of the latch and in the closed state the inner contour of the latch adjoins directly the hook tip.

Right-left circular knitting machines, that is, unifacial circular knitting machines have a sinker ring with hold-down sinkers instead of a dial. Such a ring or sinkers are needed to hold the knit product. For this purpose the sinkers, when the knitting machine needles are in their respective uppermost position, are moved past the loop forming portion of the needle and hold down the last-formed loop. During operation the knitting machine needles are exposed to a high degree of wear, for example, because of the high operating speed of the knitting machine, because of the yarns to be handled, or because of abrasive wear or other effects. The wear in most cases leads to an ever-increasing play in the latch bearing both in the axial and the radial direction resulting in lateral excursions of the latch during operation. The Coriolis force which is generated at the latches by the rotation of the cylinder of the knitting machine may amplify the lateral excursion of the latches of the knitting machine needles. If the lateral excursion of the latches is greater than the play between sinker and latch, the two frictionally engage one another, leading to lateral abrasions of the latch head.

Grooved needle latches as described in the above-noted German Patent No. 1,069,812 are particularly prone to such a wear which causes the originally rounded latch head to be transformed into a latch spoon having a groove with sharp edges. These may damage the threads which may lead to a rupture particularly of threads which break or tear relatively easily, such as elastomer threads.

German Offenlegungsschrift (application published without examination) No. 28 34 558 discloses a needle in which the needle hook is provided with a groove. Thus, the needle has a grooveless latch spoon and the latch head is configured such that it is accommodated by the deep groove in the needle hook when the latch is in its closed state. The inner contour of the closed trapping space, bounded by the hook and the latch, has at its transition from the latch to the hook a projection which prevents a thread motion within the inner space defined by the hook.

Such latch needles too, behave critically when simultaneously a plurality of threads are processed, such as, for example, during the manufacture of dual-thread knits.

British Published Patent Application No. 2,232,689 describes a latch needle for dual-thread knits. The latch needle has a pivotally supported latch which at its inner side is provided with a chamfer or step projecting into the inner space of the hook. The latch shank has a substantially constant height starting at the step and extending approximately to the rounded end of the latch shank. At its free end the latch has a latch spoon provided with a groove for receiving a portion of the hook tip. The step is configured as an oblique surface oriented in the direction of the hook tip and serves as a supporting surface for the threads of the dual-thread knit. The supporting surface is oriented toward the inner space of the hook and contacts the thread particularly when the threads lie on that border of the trapping space which is situated at the latch bearing.

During the knitting operation the threads are to be guided by the reciprocating motion of the needle from that end of the trapping space which is at the latch bearing into the inner space of the hook. Plating defects are intended to be avoided in such a needle structure as well.

SUMMARY OF THE INVENTION

It is an object of the invention to provide an improved latch needle of the above-outlined type which may be used in a diversified manner and which permits the manufacture of knit products having the desired quality.

This object and others to become apparent as the specification progresses, are accomplished by the invention, according to which, briefly stated, the latch needle includes a shank; a hook formed at an end of the shank and having a hook tip; and a latch pivotally supported by the shank and cooperating with the hook. The latch has a closed state and a reverse state. In the closed state the hook and the latch together define a closed trapping space and in the reverse state the hook defines an open trapping space constituted essentially by an inner hook space. The latch includes an inner contour facing the trapping space in the closed state, a free end lying on the hook in the closed state and a stepped portion formed on the inner latch contour and adjoining the free latch end.

The latch needle according to the invention has a latch which, at its inner contour, that is, at that side which is oriented towards the trapping space, is provided with a stepped portion. Such a stepped portion, upon withdrawal of the needle, for example, upon knockover of a loop, guides the thread in the inner hook space in the direction of the needle back and thus away from the hook tip. The step guides the thread which is situated in the trapping space and from which a loop is formed during knockover, into the inner book space and prevents the thread from wedging between the hook tip and the latch spoon which would lead to an escape of the thread between the hook tip and the latch spoon. The stepped portion according to the invention effectively prevents dropped loops from occurring.

The above applies not only to mono-thread knits but in particular to dual-thread knits in which, for example, one thread having a relatively large diameter, such as a natural fiber thread and another thread, such as an elastomer thread having a relatively small diameter, are combined with one another. The invention ensures that the thin elastomer thread too, does not leave the trapping-space and thus does not form dropped loops.

Further, the thread is prevented from running against the hook tip and from being left suspended thereon. This advantageously reduces or avoids damages to the thread. In case of a dual-thread knit, the thread is prevented from remaining suspended on the hook tip and thus from being overtaken by the other thread. Plating defects are thus securely avoided or at least significantly reduced.

Further, the stepped portion on the inner contour of the needle latch according to the invention ensures that the two threads enter the inner hook space in their original sequence. The inner contour of the trapping space is relatively smooth so that neither of the threads remains suspended on an edge or a projection during the knitting process. This is particularly so because the stepped portion provided on the latch is oriented towards the hook tip and complements therewith a substantially smooth inner contour of the trapping spaces. The stepped portion and the adjoining region of the latch thus form an approximately bridge-like structure for guiding the thread into the inner hook space in the closed state of the latch, that is, when the latch spoon lies in the hook groove. In this manner a transition is formed substantially without interruption from the lower latch shaft edge (inner contour) to the lower edge of the hook tip and the adjoining inner edge, and thus neither a slip through (dropped loops) of the yam nor a switching of the yarn sequence way occur.

Such an effect is obtained particularly if the stepped portion is adjoining the hook tip in the closed position of the latch. In such a case the remaining intermediate space between the hook tip and the stepped portion may be particularly small. Preferably, such an intermediate, generally triangular space is open in the direction of the oppositely located inner wall of the trapping space or in the direction of the inner hook space. The stepped portion is preferably configured without an undercut to avoid intolerance between the hook tip and the latch as the latch opens and closes the thread space.

The stepped portion is preferably formed by a protuberance which projects into the trapping space as an imaginary prolongation of the inner arc of the hook. This arrangement prevents either loop drops or changes in the position of threads.

Preferably, the latch needle is of the type where a groove, providing for a nesting engagement between latch and hook, is formed in the hook. Such a groove is located in the vicinity of the hook tip. A latch needle with a grooved hook has, besides the above-discussed advantages, the further advantage that it is exposed to relatively slight wear. Particularly under the rigorous conditions of use in right-left circular knitting machines in which a lateral grinding of the latches may occur as discussed earlier in connection with German Patent No. 1,069,812, the latch needle having a grooved hook has significant advantages. The latch is at its free end laterally slightly flattened and is therefore narrower than the hook and, furthermore, has no groove. If, as the lateral latch play increases, and, as a result, the latch contacts the sinkers, such an event does not lead to a sharpening of the latch head as it is the case with grooved latches. Such an arrangement counteracts a potential damaging of the threads. Such a result is particularly advantageous when delicate threads such as elastomer threads or other monofilaments are used, because the slightest damage to the surface of such threads may lead to rupture. Therefore, this measure too, leads to an improvement of the quality of the knit produced with latch needles according to the invention.

According to an advantageous feature of the invention which contributes to the above-discussed highly satisfactory results, the inner contour of the latch has rounded lateral edges. Such rounded lateral edges are, by virtue of the narrow latch in grooved-hook-type latch needles, protected for a relatively long period from lateral abrasions and thus from developing sharp edges.

In accordance with another additional advantageous feature of the invention, in the grooved-hook-type latch needle the groove is shallow at least at the hook tip but preferably in its entirety to such an extent that at no location is it deeper than one-half of the hook thickness at that location. By virtue of this feature a weakening of the hook tip is avoided. Also, no sharp edges will form at the hook tip. Such a result is achieved despite the fact that by virtue of the stepped portion at the inner contour of the latch a smooth transition from the latch to the hook space is obtained.

DESCRIPTION OF THE PREFERRED EMBODIMENTS

Figure 1:
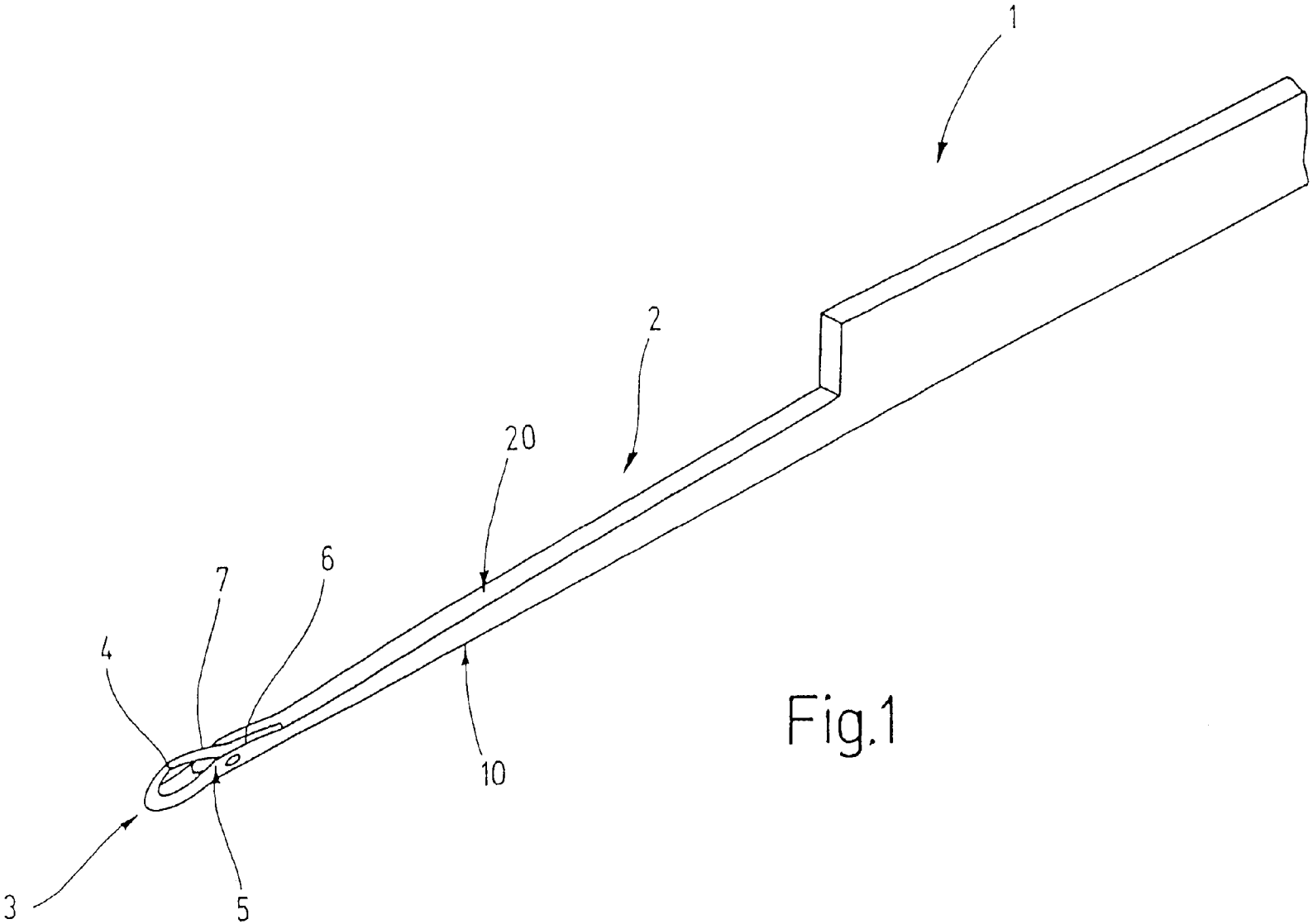
FIG. 1 is a simplified perspective view of a latch needle according to the invention.
Figure 2:
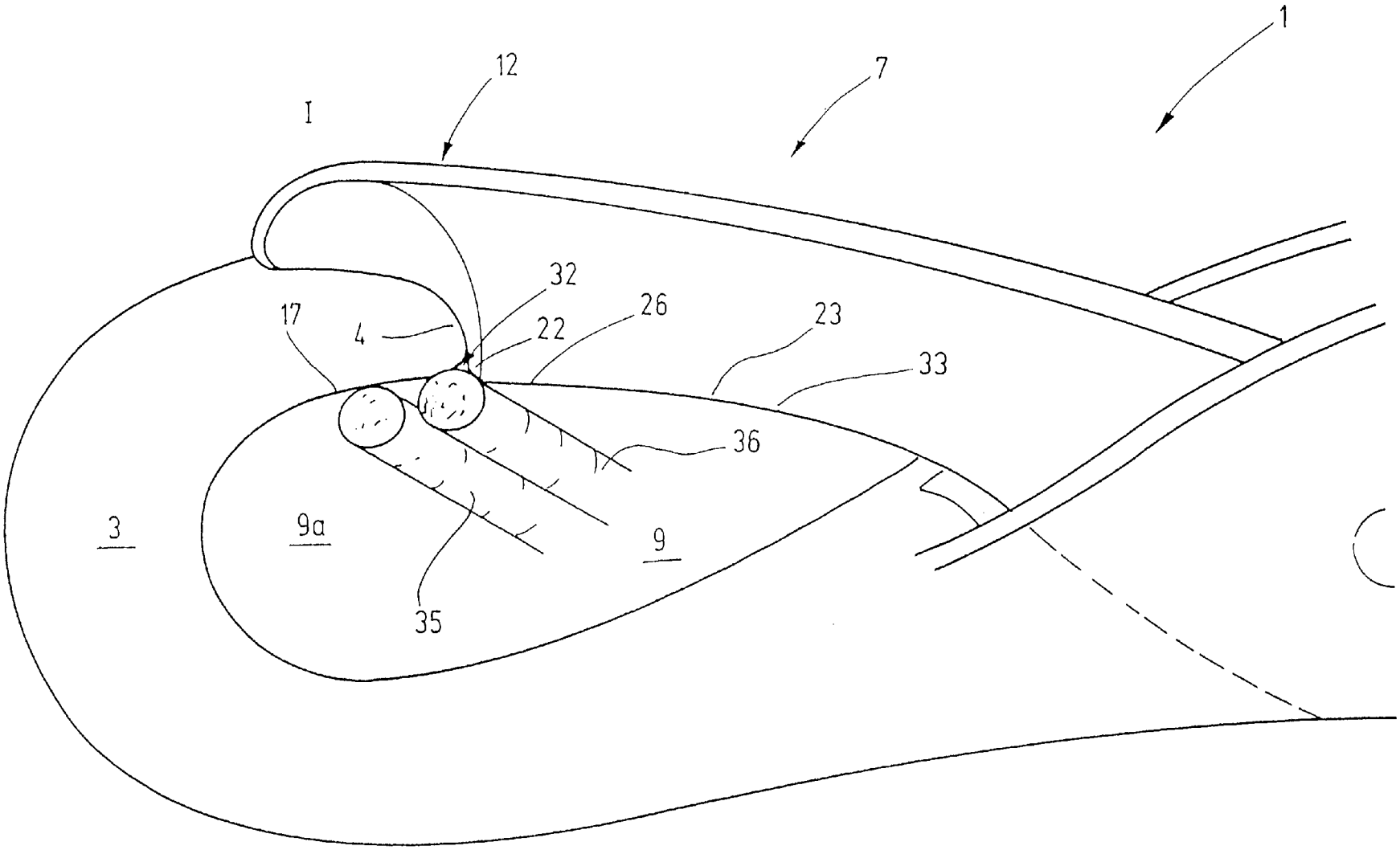
FIG. 2 is a perspective view, on a significantly enlarged scale, of an end portion of the latch needle in the closed state of the latch and illustrating two threads in the trapping space.
Figure 3:
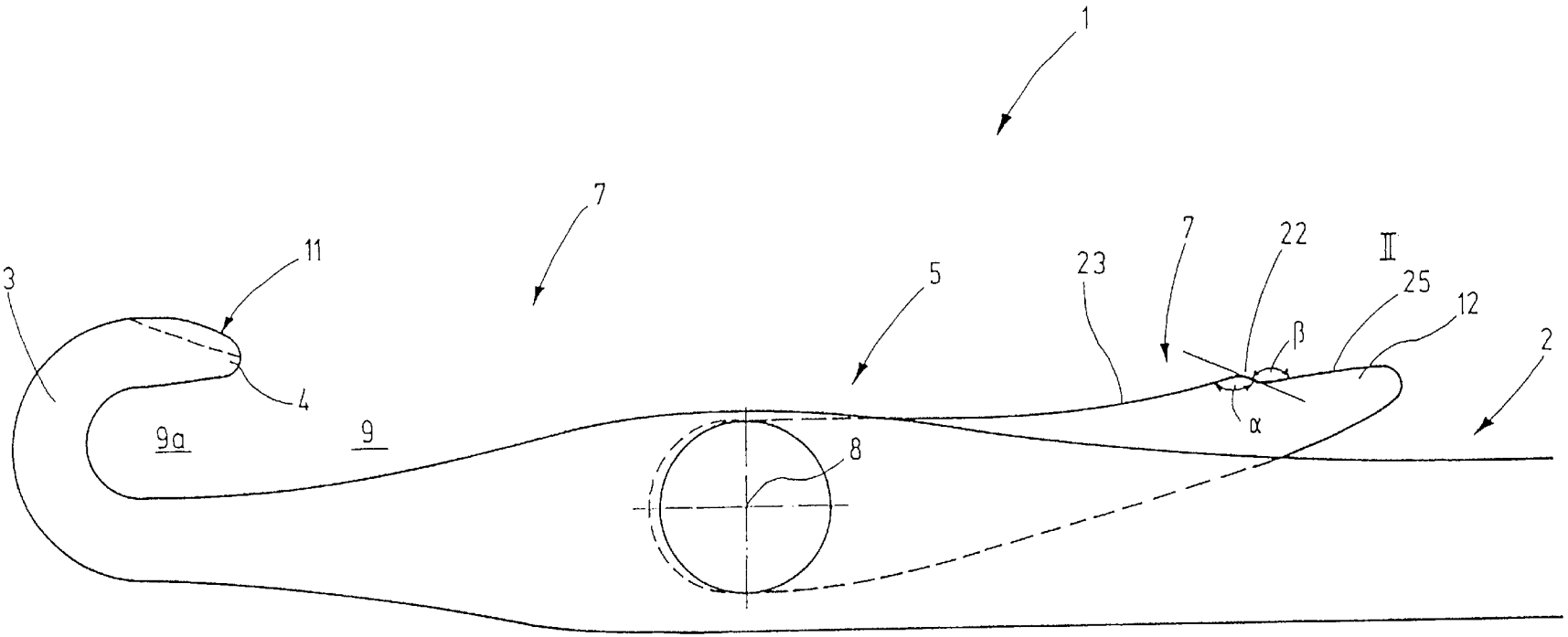
FIG. 3 is a side elevational view of the hook and latch portion of the latch needle according to the invention, illustrating the latch in a reverse (open) state.
Figure 5:
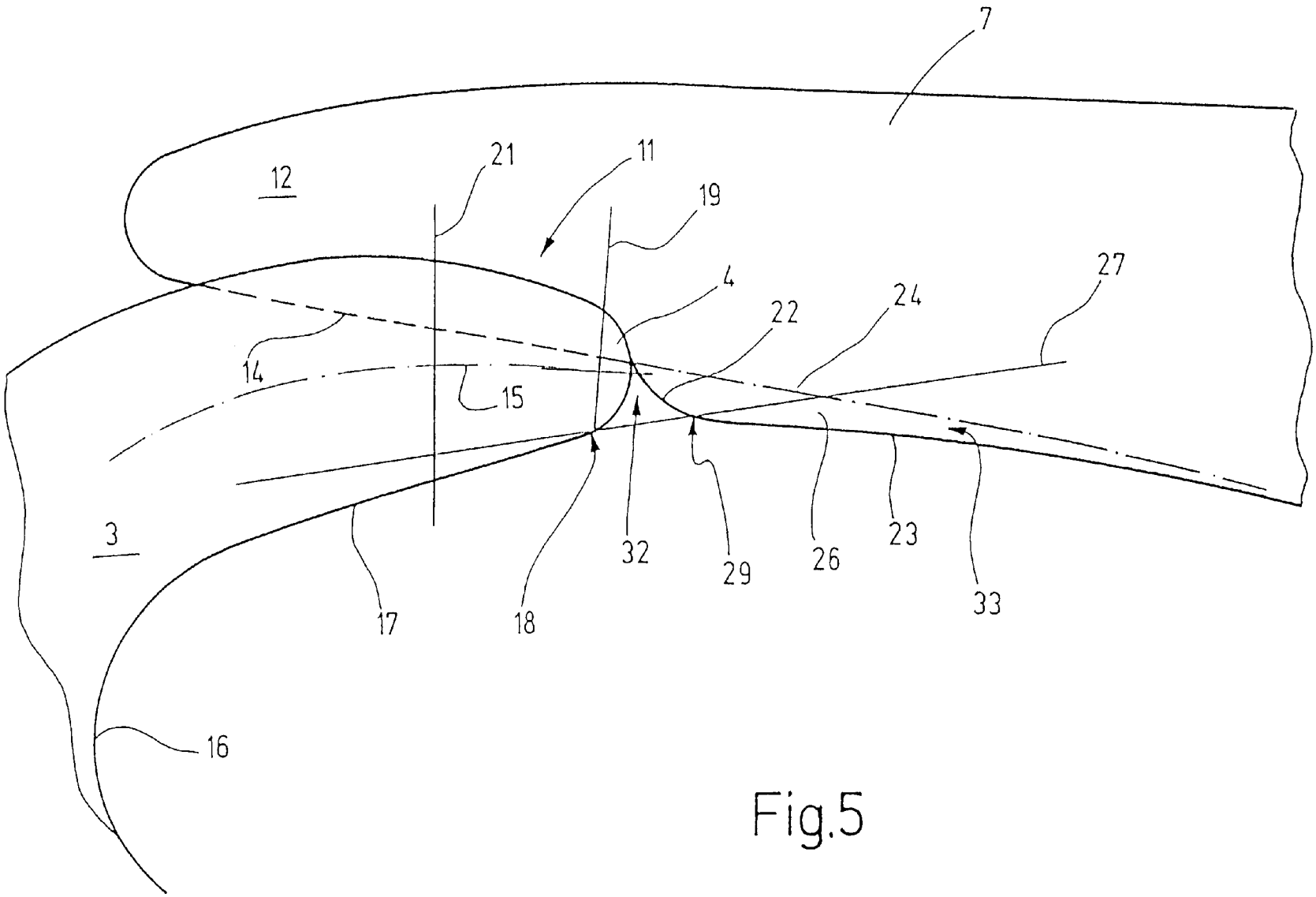
FIG. 5 is a side elevational view of the latch needle illustrated in FIG. 4, illustrated in the closed position and in an even greater enlargement.

FIG. 1 illustrates a latch needle 1 whose shank 2 is provided with a hook 3 at one end. The hook 3 is bent in a direction away from the needle back 10 and terminates in a hook tip 4 which, as may be particularly well seen in FIG. 5, is slightly spherically bent and is thus rounded. The hook tip 4 may, however, have a shape different from that shown in FIG. 5, for example, it may have a conical shape terminating essentially in a point. FIG. 1 further shows a needle cheek 5 formed between the shank 2 and the hook 3 and having a smooth transition into the upper needle side 20. A needle latch 7 is pivotally supported in a sawslot 6 provided in the cheek 5. As seen in FIG. 3, the latch 7 may move back and forth between two positions. The first position is a closed state I (FIG. 2) whereas the second position is a reverse state II (FIG. 3). The latch 7 is supported by a non-illustrated rivet defining a pivot axis 8 (FIG. 3). In the closed state I a trapping space 9 is bounded by the hook 3 and the latch 7. If the latch 7 is in the reverse state II, the trapping space 9 is open. One part of the trapping space 9 is bordered by the hook 3 and is designated as the inner hook space 9*a*.

The latch needle 1 is of the grooved hook type. This means that the hook 3, in the vicinity of the hook tip 4 has a groove 11 for accommodating a latch spoon end 12. The groove 11 is relatively flat as seen in FIG. 5. The groove 11 has preferably a bottom 14 which at the opposite longitudinal sides is bordered by the remaining walls of the groove. The bottom 14 preferably terminates short of an imaginary center line 15 of the hook cross section. It is to be understood, however, that embodiments are feasible in which the groove 11, for example, in the region of the hook tip 4, reaches or even traverses the center line 15.

As particularly well seen in FIG. 5, the hook 3 has an inner contour which, starting from a bent zone 16, continues in a region in which the hook 3 has a substantially linear inner edge 17. The latter terminates at a location 18 where the curved hook tip 4 ends. FIG. 5 shows an imaginary line 19 for distinguishing the hook tip 4 from the remaining parts of the hook 3. Approximately in the middle of the groove 11 a further line 21 is drawn at which the groove 11 has approximately its greatest depth which is less than one-half, preferably approximately by one third of the thickness.

Figure 4:
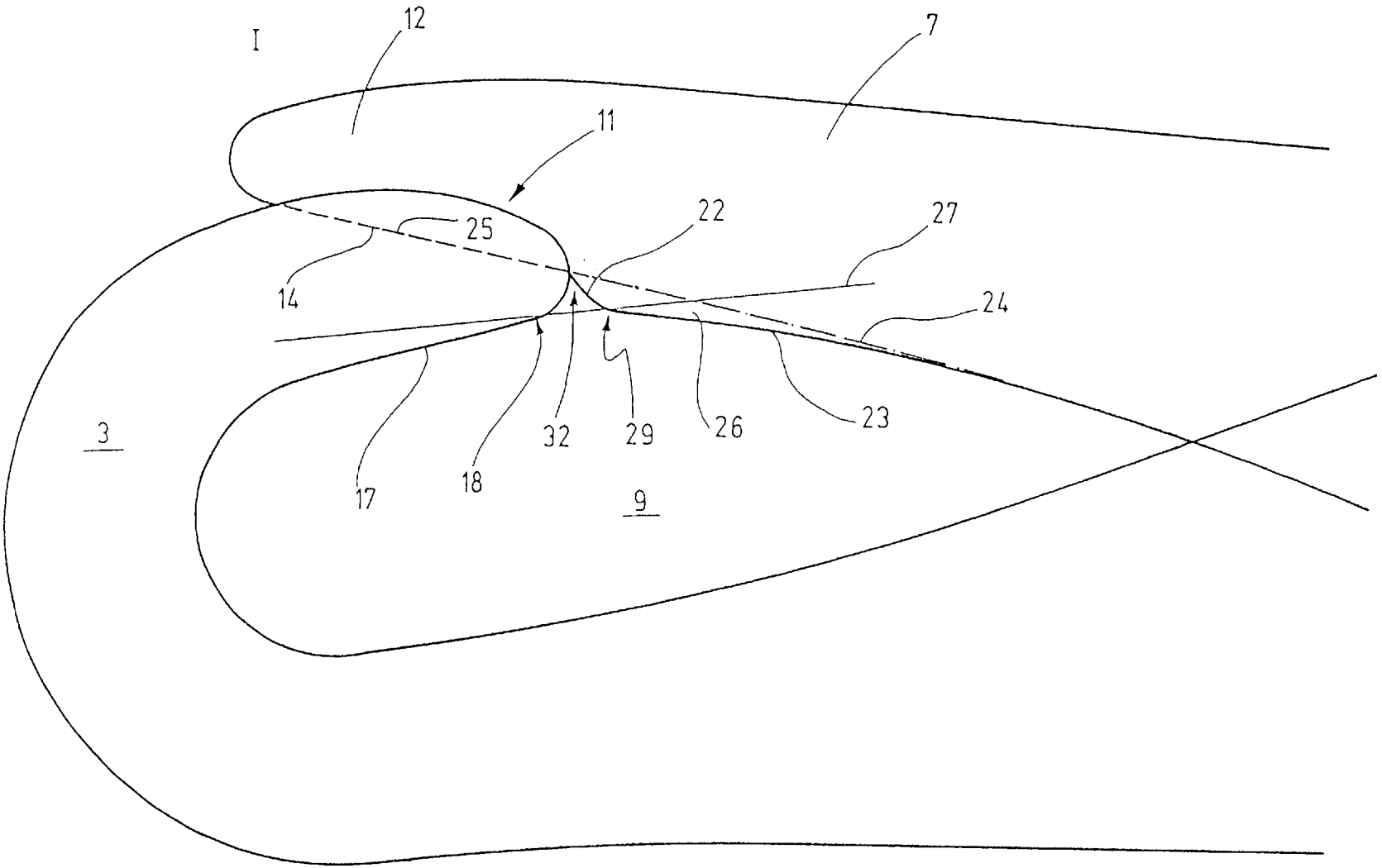
FIG. 4 is a side elevational view of the hook and latch portion of the latch needle in the closed state of the latch, as also shown in to FIG. 2.

As particularly well seen in FIGS. 4 and 5, according to the invention the latch 7 of the latch needle 1 is provided with a projection 26 which terminates in a stepped portion 22. The projection 26 and the stepped portion 22 are formed by the inner contour 23 of the latch 7 as it diverges from an imaginary broken line 24 which is the imaginary extension of the bottom 14 of the groove 11. As particularly well seen in FIG. 4, the projection-forming contour 23 deviates smoothly from the line 24 to thus provide for a gradual transistion into the projection 26. In the closed state of the latch 7 an engagement face 25 of the latch 7 lies in contact with the groove bottom 14. The stepped portion 22 begins preferably immediately at the end 12 of the latch spoon. The latch spoon end 12 projects into the groove 11 when the latch is in its closed state. In this manner the stepped portion 22 covers and thus shields the hook tip 4 so that the thread is deflected and cannot contact the hook tip 4 in the closed state of the latch 7.

The projection 26 which preferably starts at the groove 11 and allows the inner contour 23 of the latch 7 to merge smoothly into the inner edge 17 of the hook 3. Thus, the contour 23 may be regarded as having two adjoining length portions: a first length portion which coincides with the imaginary line 24 and a second length portion, constituted by the projection 26 and situated between the free end (latch spoon end 12) of the latch and the first length portion. Such a smoothly merging configuration may be particularly well seen in FIG. 5 which shows a connecting line 27 between the location 18 where the inner edge 17 of the hook 3 has its transition to the hook tip 4 and a location 29 at which the stepped portion 22 continues as the inner contour 23 of the latch 7. It is feasible to shift the location 29 into the trapping clearance 9, that is, if required, the stepped portion 22 may be significantly larger than shown in FIGS. 4 and 5. Preferably the location 29 is configured such that the connecting line 27 extends generally parallel to the working direction of the latch needle, that is, parallel to the longitudinal direction of the needle shank 2. In particular cases the location 29 may be configured such that the connecting line 27 forms an acute angle with the longitudinal direction of the shank 2 of the latch needle, wherein the point of the angle is oriented away from the hook 4.

The inner contour 23, that is, a portion of the inner surface of the latch 7 forms a sliding surface for the thread or threads to ensure an unimpeded transfer of the thread of threads to the inner hook space 9i a. The inner contour 23 is, as viewed from the trapping space 9, preferably concavely bent and thus the components 22 and 23, as viewed together, have the general shape of a ski jump.

As illustrated in FIG. 3, the stepped portion 22 is free from undercut, that is, it forms with the inner contour 23 and with the engagement face 25 obtuse angles $\alpha$ and $\beta$, respectively. Preferably, the angle $\beta$ is slightly larger than the angle $\alpha$. In this manner, as viewed from the latch bearing, an inner contour 23 of the latch is obtained which extends away from the line 24 into the trapping space 9.

As may be observed in FIGS. 4 and 5, in the closed state of the latch 7 the projection 26 and its stepped portion 22 do not overlap the hook tip 4 and thus between the hook tip 4 and the stepped portion 22 a gap 32 is formed which has the shape of an equilateral or isosceles triangle. The gap 32 is preferably so narrow that no thread can penetrate thereinto. This then means that the distance of the location 18 from the location 29 is preferably less than the diameter of the thinnest thread (FIG. 2) that can be expected to be processed by the latch needle 1. Further, both the inner edge 17 of the hook 3 and the inner contour 23 of the latch 7 are rounded, especially at their lateral edges 33.

In the description which follows the operation of the above-described latch needle 1 according to the invention will be set forth.

The latch needle 1 may be utilized as a conventional latch needle, particularly as a substitute or replacement for conventional needles. It is adapted, like other latch needles, for processing conventional threads and yarns under the usual operational conditions. The needle according to the invention, however, is particularly adapted for processing delicate threads, monofils like elastomer threads and for making plated wear, that is, two or three-thread knits.

For receiving a thread, the latch needle 1 is moved into its outward position whereby the latch 7, as shown in FIG. 3, is moved by the thread, situated in the trapping space 9, into the reverse (open) state II. Thereafter, the thread glides over and beyond the inner contour 23 of the latch 7 until the thread lies against the upper needle side 20 which is opposite the needle back 10. The hook 3 may now capture, for example, two threads 35, 36 (FIG. 2) whereupon the latch needle 1 starts its reverse stroke. Upon such an occurrence the latch 7 snaps into its closed state I, thus closing the trapping space 9. The threads 35, 36, which, while in FIG. 2 are shown to have the same diameter, may have different diameters, are now within the trapping space 9 and may move therein. If upon such a movement they glide along the inner contour 23 into the inner hook space 9*a* surrounded partially by the hook 3, they traverse the gap 32 situated between the stepped portion 22 and the hook tip 4 without running onto the hook tip 4. Rather, the projection 26 forms, similarly to a ski jump or a bridge, a transition from the inner contour 23 of the latch 7 to the inner edge 17 of the hook 3. The threads 35, 36 thus run smoothly over the gap 32 without changing their position relative to one another.

Further, there is no risk that one of the threads wedges in the gap 32 and opens the latch or that the thread slips through between the hook tip 4 and the latch spoon end 12. Thus, with the latch needle according to the invention high quality products may be manufactured without drop loops or thread displacements under stringent operational conditions or quality requirements demanded by the thread quality or the number of threads to be processed. Further, the latch 7 is narrow and has no groove so that even in case of an enlarged lateral latch play which develops over time, there is no danger that the side edges 33 could be sharpened by a grinding effect which would damage the delicate threads.

Figure 6:
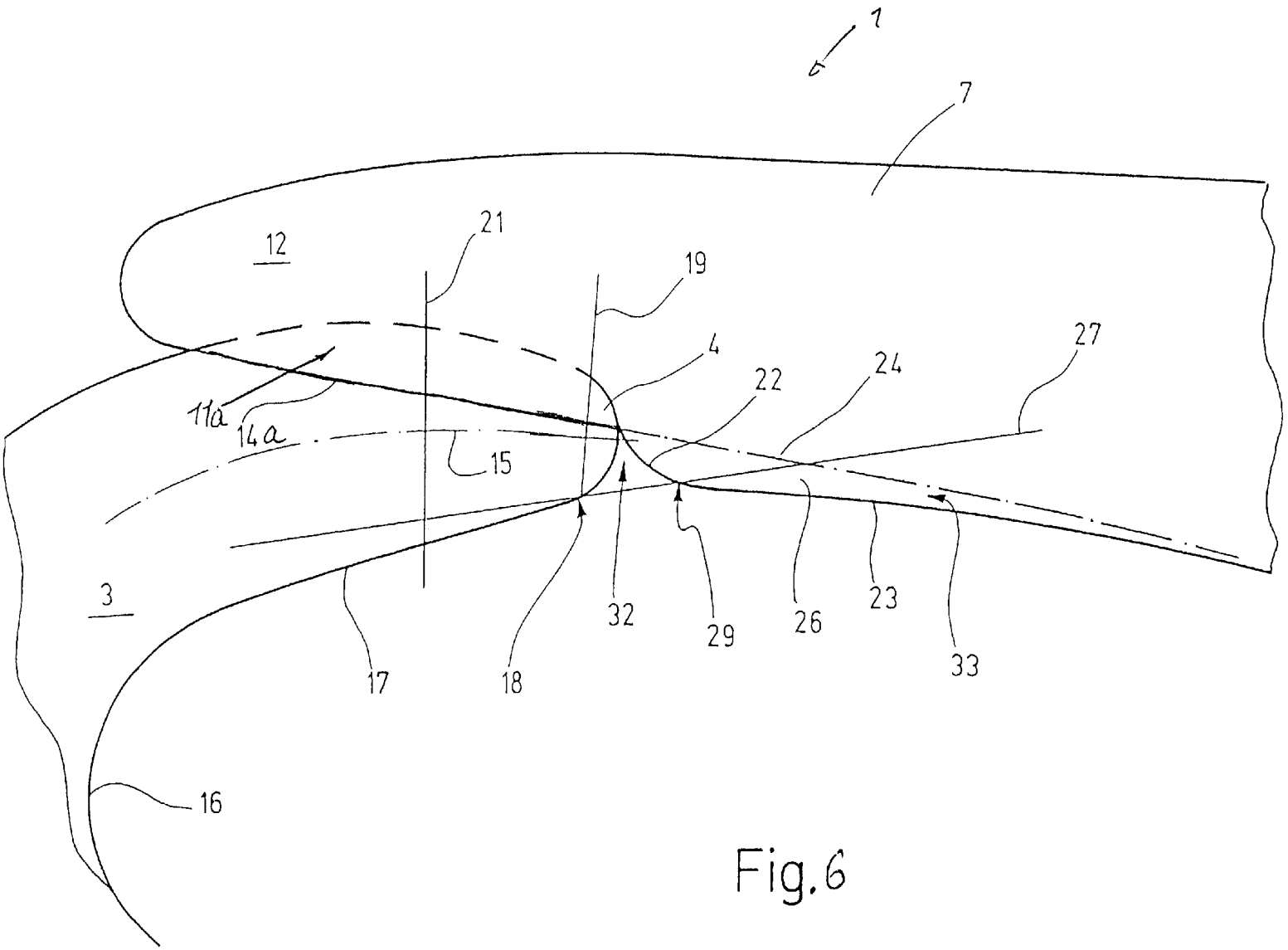
FIG. 6 is a side elevational view of the hook and latch portion of a grooved-latch-type needle according to the invention.

A further embodiment of the invention is illustrated in FIG. 6. In this embodiment the latch needle is of the grooved latch type, that is, the latch spoon end 12 forming the free end of the latch 7 is provided with a groove 11*a*. The groove 11*a* accommodates the hook 3 when the latch 7, in its closed state, lies against the hook 3 with its latch spoon end 12. The groove 11*a* is surrounded by an edge 14*a* whose linear imaginary prolongation is shown as a line 24 in FIG. 6. The projection 26, as in the earlier-described embodiment, extends in the direction of the hook space beyond the line 24. The projection 26 may continue with a stepped portion 22 having a shape merging into the edge 14*a* of the groove 11*a*. It is, however, feasible to configure the inner contour of the latch 7 such that the edge 14*a* of the latch 7, starting approximately at the location 29, extends approximately linearly to the latch tip 12. It is of importance in this construction that the latch 7, when in the closed state, defines a substantially smooth transition to the hook 3. Stated differently, the inner edge 17 adjoins substantially smoothly the inner contour 23. To illustrate such a condition, in FIG. 6*a* line 27 is shown which connects the location 18 at which the linear inner edge 17 terminates, with the location 29 at which the substantially straight inner contour 23 terminates. The orientation of the line 27 approximately coincides with the orientation of the needle back 10.

It will be understood that the above description of the present invention is susceptible to various modifications, changes and adaptations, and the same are intended to be comprehended within the meaning and range of equivalents of the appended claims.

What is claimed is:

1. A latch needle comprising (a) a shank;

(b) a hook formed at an end of said shank and having a hook tip; and (c) a latch pivotally supported by said shank and cooperating with said hook; said latch having a closed state and a reverse state; in said closed state said hook and said latch together defining a closed trapping space and in said reverse state said hook defining an open trapping space comprising an inner hook space; said latch including (1) a free end lying on said hook in said closed state; and (2) an inner contour facing said trapping space in said closed state; said inner contour having a first length portion and an adjoining second length portion; said second length portion being formed by a projection terminating a stepped portion; said projection being situated between said free end and said first length portion; said first length portion having a smooth and gradual transition into said second length portion; said stepped portion being located between said free end of said latch and said transition and facing said free end; said projection being in a non-overlapping relationship with said hook in said closed state of said latch; said projection jutting beyond said first length portion and shielding said hook tip in said closed state of said latch for deflecting a thread away from said hook tip.

2. The latch needle as defined in claim 1, further comprising a needle back; further wherein said hook tip has a curved contour merging into an inner contour of said hook at a first location; said stepped portion merging into said inner contour of said latch at a second location situated at a height such that, in said closed state, an imaginary straight line interconnecting said first and second locations extends parallel to said needle back.

3. The latch needle as defined in claim 1, further comprising a needle back; further wherein said projection jutting into said trapping space in said closed state of said latch; and further wherein said hook tip has a curved contour merging into an inner contour of said hook at a first location; said stepped portion merging into said inner contour of said latch at a second location situated at a height such that an imaginary straight line interconnecting said first and second locations forms an acute angle with said needle back.

4. The latch needle as defined in claim 1, wherein in said closed state of said latch a gap is defined by said hook and said stepped portion; said gap being narrower than an expected minimum diameter of a thread processed by said latch needle.

5. The latch needle as defined in claim 1, wherein said latch has a width dimension measured perpendicularly to a pivotal plane of said latch; said width dimension decreasing toward a terminus of said free end.

6. The latch needle as defined in claim 1, wherein said latch has a groove for receiving a portion of said hook in the closed state of said latch; further wherein said free end has an engagement face cooperating with said groove and an imaginary prolongation of said engagement face forms a line; said stepped portion being situated between said trapping space and said line.

7. The latch needle as defined in claim 1, wherein said latch has rounded lateral edges at said inner contour.

8. The latch needle as defined in claim 1, wherein said latch has a height dimension measured parallel to a pivotal plane of said latch; said height dimension decreasing toward a terminus of said free end.

9. The latch needle as defined in claim 1, wherein said hook has a groove receiving said free end of said latch in said closed state thereof; further wherein said free end has an engagement face cooperating with said groove and an imaginary prolongation of said engagement face forms a line; said stepped portion being situated between said trapping space and said line.

10. The latch needle as defined in claim 9, wherein said groove of said hook has a greatest depth which, is less than one half of the thickness of the hook.

11. The latch needle as defined in claim 9, wherein said groove of said hook has a greatest depth which, is approximately one third of the thickness of the hook.

* * * * *